US007059416B2

(12) United States Patent
Dailey et al.

(10) Patent No.: US 7,059,416 B2
(45) Date of Patent: Jun. 13, 2006

(54) BUOYANCY CAN FOR OFFSHORE OIL AND GAS RISER

(75) Inventors: James Elvin Dailey, Spring, TX (US); Metin Karayaka, Houston, TX (US)

(73) Assignee: Technip France, Courbevoie (FR)

( * ) Notice: Subject to any disclaimer, the term of this patent is extended or adjusted under 35 U.S.C. 154(b) by 49 days.

(21) Appl. No.: 10/719,780

(22) Filed: Nov. 21, 2003

(65) Prior Publication Data

US 2005/0109513 A1 May 26, 2005

(51) Int. Cl.
*E21B 29/12* (2006.01)

(52) U.S. Cl. ..... 166/359; 166/367; 405/224.2

(58) Field of Classification Search ..... 166/350, 166/355, 359, 367; 405/200, 205, 206, 224.2, 405/224.3, 224.4
See application file for complete search history.

(56) References Cited

U.S. PATENT DOCUMENTS 3,992,735 A * 11/1976 McCarthy ..... 441/133
4,102,142 A * 7/1978 Lee ..... 405/224.2
4,126,011 A * 11/1978 Lamy et al. ..... 405/196
4,176,986 A * 12/1979 Taft et al. ..... 405/211
4,646,840 A * 3/1987 Bartholomew et al. ..... 166/350
4,657,439 A * 4/1987 Petersen ..... 405/200
5,330,293 A * 7/1994 White et al. ..... 405/211
5,722,340 A * 3/1998 Sweetman ..... 114/243
6,004,074 A * 12/1999 Shanks, II ..... 405/195.1
6,030,145 A * 2/2000 Stewart et al. ..... 405/172
6,270,387 B1 * 8/2001 Nesheim ..... 441/133
6,435,775 B1 * 8/2002 Nish et al. ..... 405/224.2
6,585,455 B1 * 7/2003 Petersen et al. ..... 405/224.4
6,786,679 B1 * 9/2004 Huang et al. ..... 405/209
2002/0142683 A1 * 10/2002 Campbell et al. ..... 441/133

* cited by examiner

*Primary Examiner*—Thomas A Beach
(74) *Attorney, Agent, or Firm*—Klein, O'Neill & Singh, LLP; Howard J. Klein

(57) ABSTRACT

A buoyancy can for supporting an offshore oil and gas riser includes an axial bore through which the riser extends coaxially, and a radio-axial slot extending through a side of the can and into the axial bore. A pair of spaced-apart support features are disposed coaxially on the riser, and the can includes a pair of corresponding sockets in the axial bore thereof. The sockets are adapted to receive and vertically support respective ones of the support features in a complementary, axial engagement. The can is placed in the water and moved laterally relative to a fully assembled, vertically supported riser such that the riser passes through the radio-axial slot of the can and into the axial bore thereof without the need for disassembly of the upper portion of the riser. The relative vertical positions of the can and riser are then adjusted such that the support features engage and seat within respective ones of their complementary sockets.

13 Claims, 8 Drawing Sheets

BUOYANCY CAN FOR OFFSHORE OIL AND GAS RISER

CROSS-REFERENCE TO RELATED APPLICATIONS (Not Applicable)

STATEMENT REGARDING FEDERALLY SPONSORED RESEARCH OR DEVELOPMENT (Not Applicable)

REFERENCE TO APPENDIX (Not Applicable)

BACKGROUND OF THE INVENTION

1. Field of the Invention

This invention relates, in general, to methods and apparatus for offshore oil and gas production, and in particular, to a buoyancy can for tensioning, or supporting, the upper end of an offshore oil and gas riser that can be coupled to and decoupled from the riser without disassembling the upper terminal end portion thereof.

2. Related Art

Top-tensioned riser ("TTR") systems for offshore oil and gas production (see, e.g., U.S. Pat. No. 4,702,321 to E. E. Horton) use passive "buoyancy cans" to support the risers independently of an associated floating production platform. In such a system, the riser extends vertically upward from the sea floor through the keel of the platform, and thence, to the well deck thereof, where it connects to a "stem" pipe, to which the buoyancy can is attached. The stem pipe extends vertically upward through an axial bore in the can and exits through its upper surface, where it may support a "work platform" to which the riser and its associated surface tree or "goose neck" are attached. A flexible, high pressure jumper then connects the outlet of the surface tree or goose neck to the production deck of the platform.

By comparison, a "hybrid" riser system typically comprises three main parts: A foundation anchor and flow-line interface unit, a multi-bore riser string, and a top end buoyancy can, which also carries the respective interfaces for the flexible jumpers, and which may be deployed on either the surface of the water or submerged below it. In such systems, the riser string is fabricated onshore as a complete, single-piece unit for tow-out and installation with a minimum of offshore work. The flexible jumpers are installed separately as part of the commissioning work, and the flow-lines are pulled in to the platform, which is outfitted with standard "hang-off" porches.

In either case, since the riser is independently tensioned, or supported, by the buoyancy can relative to the production platform, the platform can move relative to the riser, and indeed, may even temporarily depart from the production location, such that the riser is thereby independent of and isolated from the motions of the platform. However, in such an arrangement, the buoyancy can must have sufficient buoyancy to provide the required top tension in the riser, as well as support for the weight of the can, the stem pipe and at least part of the weight of the jumpers.

When a buoyancy can is initially deployed on a riser, or alternatively, when a deployed can is replaced with another can for repair or maintenance reasons, it is necessary to temporarily support the riser at a point below the can, and to remove the upper end, or terminal, portion of the riser, including the tree and any goose neck thereon, so that the "old" can, if any, may be slid up and off of the riser, and the "new" can may be slid down and over the riser. The upper terminal end portion of the riser must then be replaced and coupled to the new can for support. This results in a fairly complex, time-consuming, expensive, and potentially risky operation, particularly if effected in moderate or heavy seas.

A long felt but as yet unsatisfied need therefore exists for a buoyancy can that can be coupled to and decoupled from a riser either on or below the surface of the water without the need for removing the upper terminal end portion of the riser.

BRIEF SUMMARY OF THE INVENTION

In accordance with the present invention, a buoyancy can for supporting the upper end of an elongated vertical offshore oil and gas riser, and a method for its use, are provided that enable the can to be coupled to and decoupled from the riser without the need for removing the upper end portion of the riser. The novel can comprises at least one conventional vertical axial bore through which the riser extends coaxially, and a radio-axial slot having a width slightly greater than the diameter of the riser extending through a side of the can and into the axial bore.

In one exemplary embodiment thereof, the riser includes at least one support feature, e.g., a hang-off plug, disposed coaxially thereon adjacent to the upper end of the riser, and the buoyancy can comprises a corresponding socket disposed at the upper end of the axial bore thereof. The socket is adapted to receive the support feature in a complementary, axial engagement, and thereby support the at least one support feature in the vertical direction.

In another, more advantageous embodiment, the riser further includes a second support feature, e.g., a riser ball of a given diameter, disposed coaxially thereon at a selected distance below the first support feature, and the buoyancy can further comprises a corresponding second socket, e.g., a conventional keel joint socket, disposed in the axial bore thereof. The second socket is spaced below the first socket the same distance as the second support feature is spaced below the first support feature, and is adapted to receive the second support feature in a complementary, axial engagement, and thereby support it in the vertical direction. In this embodiment, the radio-axial slot is modified to include a radial bore that extends through the side of the can and into the axial bore, and the radial bore includes a cross-sectional profile that is slightly larger than the corresponding cross-sectional profile of the riser ball or other second support feature.

In another possible embodiment, the first support feature and corresponding first socket may respectively comprise a conventional flex joint and a complementary receptacle therefor. In yet another possible embodiment, the second socket may be disposed at a lower end of the buoyancy can and comprise a conventional keel joint sleeve. In still yet another embodiment, the second support feature may comprise a conventional stab-in connector. In these embodiments, the utilization of two spaced-apart support features on the riser and corresponding sockets in the can ensures that loads caused by lateral wave or surge movements of the can are applied to the upper end of the riser in the form of a couple that is distributed throughout substantially the length of the can, rather than at a single point therein, which substantially reduces the stresses and strains imposed on the riser by lateral movements of the can.

Advantageously, the buoyancy can includes at least one buoyant compartment that has a buoyancy that can be adjusted, e.g., with ballast water, to enable precise control of the vertical position of the can in the water. Additional ones of the compartments may be pressurized, e.g., with compressed air, to offset large hydrostatic pressures acting on them at greater water depths.

A method for coupling the novel buoyancy can to the riser without removing the upper terminal end portion of the riser comprises suspending the upper end portion of the riser, e.g., with a floating crane, such that the lower end of the riser extends vertically below the surface. The can is then disposed in the water adjacent to the riser, with the radio-axial slot aligned toward the riser. The can and the riser are then moved together laterally in the water, which can be effected completely below the surface of the water without the use of divers by use of a remotely operated vehicle ("ROV"), such that the riser passes through the radio-axial slot in the can and is disposed coaxially in the axial bore thereof. When the riser is positioned in the axial bore of the can, the vertical position of at least one of the riser and the can are adjusted, i.e., the can is de-ballasted such that it rises, and/or the upper end of the riser is lowered, such that the support features on the riser axially engage and are seated in respective ones of their corresponding sockets in the bore of the can.

A buoyancy can in accordance with the invention can be configured to support a plurality of risers in a so-called "riser tower" arrangement.

A better understanding of the above and many other features and advantages of the present invention may be obtained from a consideration of the detailed description thereof below, particularly if such consideration is made in conjunction with the several views of the appended drawings.

DETAILED DESCRIPTION OF THE INVENTION

Figure 1:
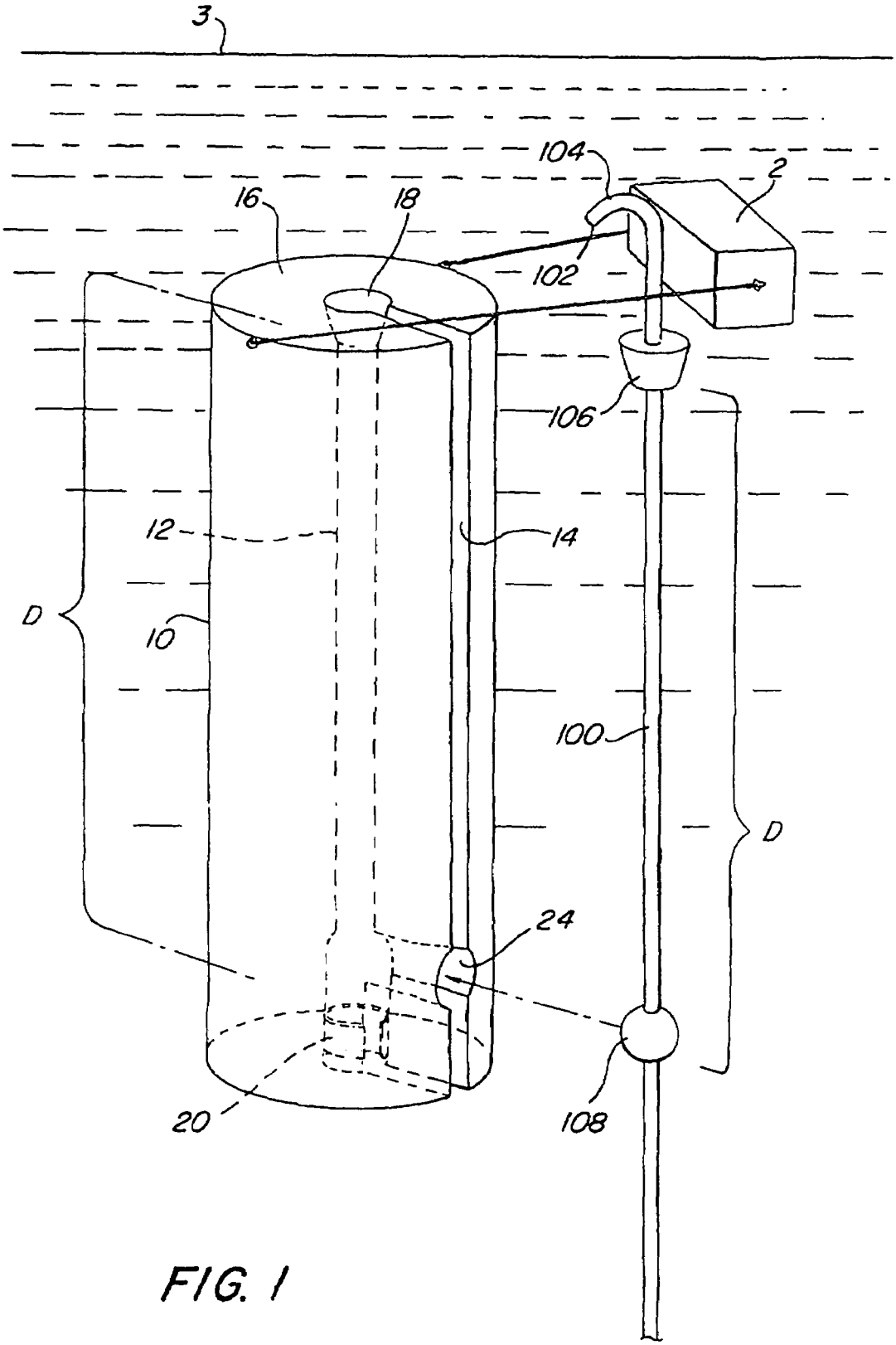
FIG. 1 is perspective view of an exemplary embodiment of a buoyancy can in accordance with the present invention being deployed in a body of water and coupled to the upper end portion of an associated offshore oil and gas riser.
Figure 2A:
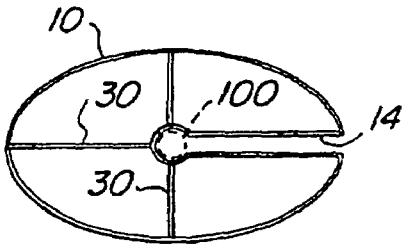
FIGS. 2*a*–2*d* illustrate possible exemplary cross-sectional views of the buoyancy can.
Figure 2B:
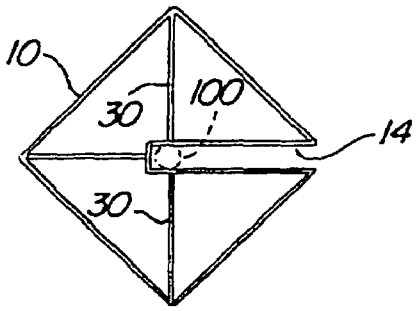
Figure 2C:
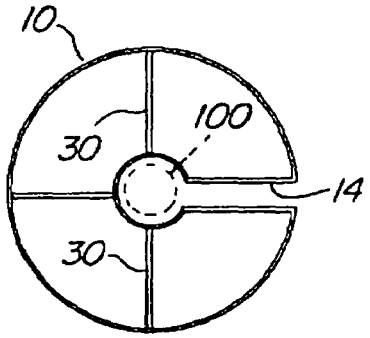
Figure 2D:
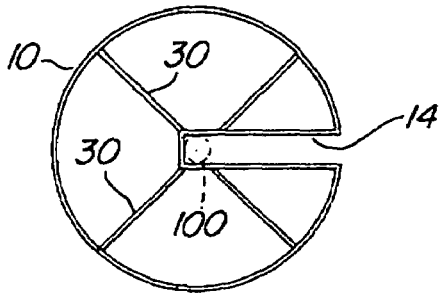

A perspective view of an exemplary embodiment of a buoyancy can 10 in accordance with the present invention being deployed in a body of water and coupled to the upper end portion of an associated offshore oil and gas riser 100 is illustrated in FIG. 1. The buoyancy can comprises a single vertical axial bore 12 through which the riser extends coaxially in a conventional manner, and a radio-axial slot 14 that extends through a side of the can and into the axial bore. The slot 14 has a width that is greater than the diameter of the riser 100 to enable the riser to pass through the slot laterally and into the axial bore 12.

For simplicity of description, the particular embodiment of buoyancy can 10 and riser 100 described and illustrated herein is shown to include only a single axial bore 12 and corresponding single riser. However, a typical hybrid riser "tower" may include a buoyancy can 10, such as that illustrated in FIG. 10, which supports several such risers simultaneously, each seated in its own corresponding respective axial bore 12, and accordingly, it should be understood that this invention is equally applicable to such multi-riser systems.

In the exemplary embodiment illustrated, the riser 100 comprises a cylindrical pipe of a given diameter that extends vertically upward from a foundation 5 (see, FIG. 5) on the sea floor 1 and through the axial bore 12 of the can 10 such that its upper end 102 exits through the upper end 16 of the can. The particular riser illustrated includes a recurvate goose neck section 104 at its upper end, as well as a first riser support feature 106, viz., a conventional, frusto-conical "hang-off plug," disposed coaxially thereon adjacent to the upper end thereof. The buoyancy can 10 further comprises a corresponding first receptacle, or frusto-conical "socket" 18, disposed at the upper end of the axial bore 12 of the can. The socket 18 is adapted to receive the hang-off plug in a complementary, slide-in, axial engagement, and to support the hang-off plug, and hence, the riser, in the axial, or vertical, direction when the plug is seated therein.

Figure 6:
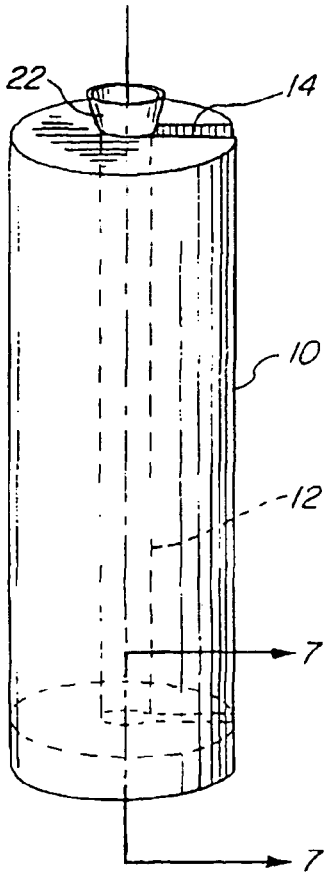
FIG. 6 is a perspective view of a buoyancy can in accordance with the invention having a flex joint socket at its upper end and a keel joint at its lower end.
Figure 8:
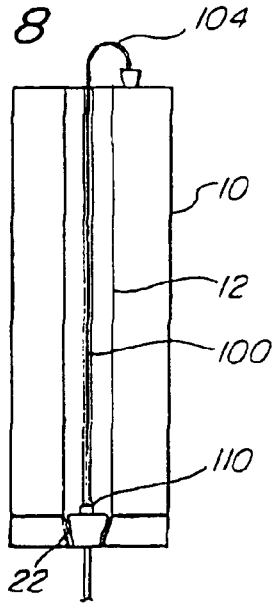
FIG. 8 is a cross-sectional elevation view of a buoyancy can incorporating a flex joint and stab-in connector at its lower end.
Figure 7:
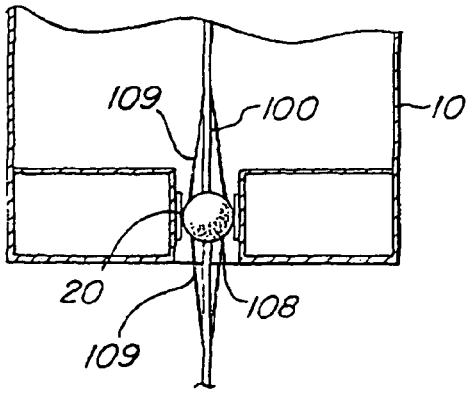
FIG. 7 is an enlarged partial cross-sectional view of the keel joint of the buoyancy can of FIG. 6, as seen along the section lines 7–7 taken therein.

The exemplary riser 100 advantageously further includes a second support feature 108 disposed coaxially thereon at a selected distance D below the first support feature 102, as illustrated in FIG. 1, and a corresponding second socket 20, which is spaced below the first socket 18 by the selected distance D, is disposed in the axial bore 12 of the buoyancy can 10. Like the first socket 18, the second socket 20 is adapted to receive the second riser support feature 108 in a complementary, slide-in, axial engagement, and to support the second support feature, and hence, the riser, in the vertical direction when the latter support feature is seated therein. In the particular embodiment illustrated in FIG. 1, the second riser support feature 108 comprises a conventional keel joint riser ball having a given diameter, and the second socket 20 comprises a conventional keel joint sleeve disposed in the axial bore of the can at its lower end, as is also illustrated in FIGS. 6 and 7, respectively. Alternatively, as illustrated in FIG. 8, the second riser support feature 108 and corresponding second socket 20 disposed at the lower end of the can 10 may comprise a conventional stab-in connector 110 and flex joint receptacle 22, instead of the keel joint ball and sleeve illustrated in FIGS. 6 and 7.

Figure 4:
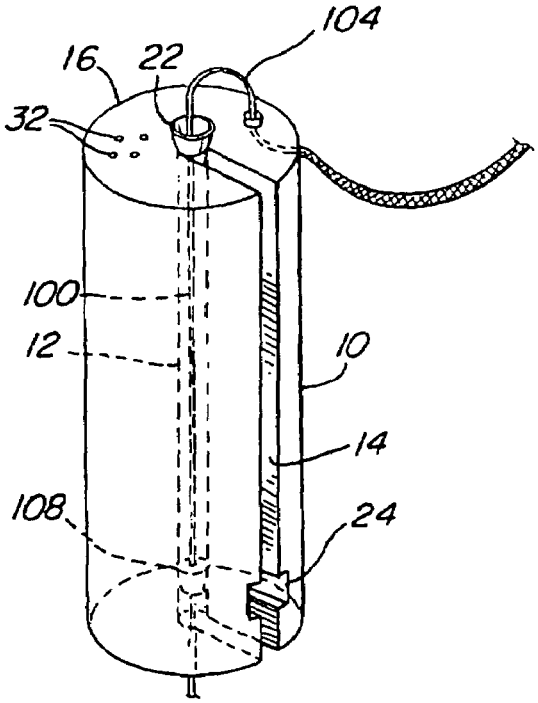
FIG. 4 is a perspective view of an exemplary buoyancy can incorporating a goose neck at its upper terminal end.

However, as will be appreciated by those of skill in the art, since a keel joint riser ball (or other type of riser support feature) has a diameter or other cross-sectional profile that is greater than that of the riser 100 itself, and because such feature is positioned, when installed, between the upper and lower ends of the buoyancy can 10, it cannot pass laterally through the radio-axial slot 14 of the can in the manner described below without some modification of the slot. Accordingly, to accommodate the second riser support feature 108, the radio-axial slot is provided with a radial bore 24 having a cross-sectional profile that is slightly larger than the corresponding cross-sectional profile of the second riser support feature 108, and which extends through the side of the can and into the axial bore 12 thereof, as illustrated in FIGS. 1 and 4, so that the riser, with a riser ball, stab-in connector, or other type of second riser support feature installed thereon, can both pass transversely through the radio-axial slot and into the axial bore of the can simultaneously, in the manner described below.

Figure 9:
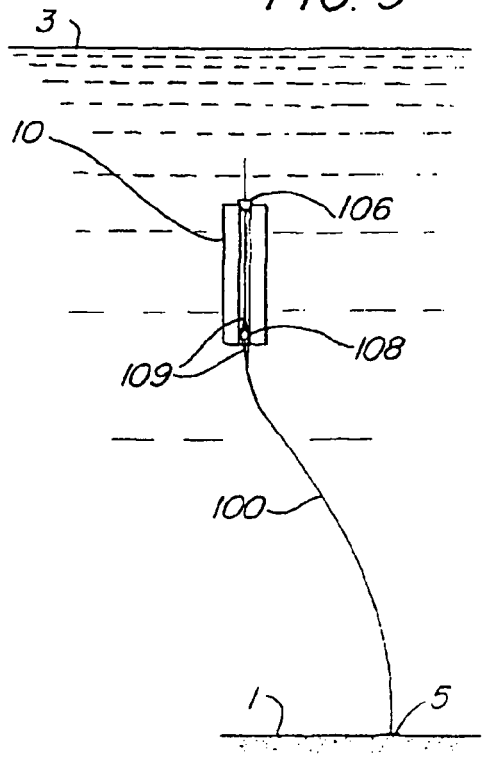
FIG. 9 is a cross-sectional schematic elevation view of a buoyancy can in accordance with the present invention shown supporting the upper end of an offshore riser; and, FIG. 10 is perspective elevation view of an exemplary embodiment of a buoyancy can in accordance with the present invention that is capable of supporting a plurality of risers.

As will be further appreciated by those of skill in this art, the present invention's use of two axially spaced-apart support features 106, 108 on the riser 100, operating in conjunction with two corresponding spaced-apart sockets 18 and 20 in the buoyancy can 10, provides advantages over prior art buoyancy cans employing only one set of such supports and sockets. As illustrated in FIG. 9, it may be seen that, as the buoyancy can 10 is subjected to lateral sea motions caused by wave or surge forces acting upon it, the resulting loads imposed on the upper end portion of the riser 100, which is tethered at its lower end to a foundation 5 on the sea floor 1, are transferred through two transfer points, rather than only one point, as with conventional buoyancy cans. This results in a riser curvature that conforms more gently to the vertical axis of the buoyancy can, and thereby reduces the bending stresses and resulting fatigue acting on the riser caused by such motions, relative to those of conventional, single-point buoyancy can riser support systems. This effect can be further enhanced by the provision of back-to-back stress joints 109 to accommodate localized bending stresses in the vicinity of the riser ball 108, as illustrated in FIGS. 7 and 9.

In a preferred embodiment, the buoyancy can 10 includes at least one floatation compartment 26 having a buoyancy that is selectably adjustable, so that the vertical position and angular orientation of the can in the water can be controlled relatively precisely. This compartmentalization can be effected by the provision of conventional horizontal and vertical bulkheads 28 and 30, as illustrated in FIGS. 2*a*–2*d* and 3. As illustrated in FIGS. 2*a*–2*d*, the can itself may comprise a variety of cross-sectional shapes, including elliptical, oval, square, or round. Additionally, the vertical bulkheads 30 can be arranged in various ways to accommodate and/or define the axial bore 12 and radio-axial slot 14 of the can.

Figure 3:
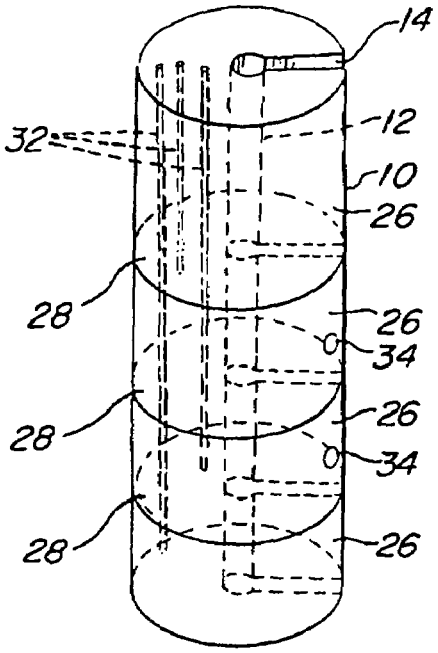
FIG. 3 is a perspective view of an exemplary buoyancy can containing compartments in which the level of water ballast and/or the internal pressure can be varied with a pressurized fluid.

As illustrated in FIG. 3, the buoyancy of the compartments 26 of the can 10 can be adjusted by means of a pressurized fluid, e.g., compressed air, that is fed into or vented from them by individual conduits 32 that extend into the compartments from, e.g., the upper end 16 of the can. Some of the compartments may include side openings 34 through which sea water ballast can be admitted or expelled by venting or pressurizing the compartment, while others can be completely closed, to enable them to be internally pressurized in an amount sufficient to offset the hydrostatic pressure acting on them at greater water depths. The pressurization can be remotely effected, for example, with the use of a Remotely Operated Vehicle ("ROV") 2 (see, FIG. 1). The foregoing arrangement advantageously enables the buoyancy of the can, and hence, its orientation and vertical position in the water, to be adjusted with precision during the coupling and de-coupling of the can to the riser 100, as described below.

A method by which the novel buoyancy can 10 may be coupled to and decoupled from a riser 100 without removing the upper terminal end portion of the riser is illustrated in FIGS. 1 and 5A–5D. The method begins by suspending the upper end portion of the riser 100, e.g., with a barge-mounted crane 4, such that the lower end of the riser, including any second riser support feature 108 mounted thereon, such as the riser ball illustrated, extends downward toward the sea floor 1.

Figure 5A:
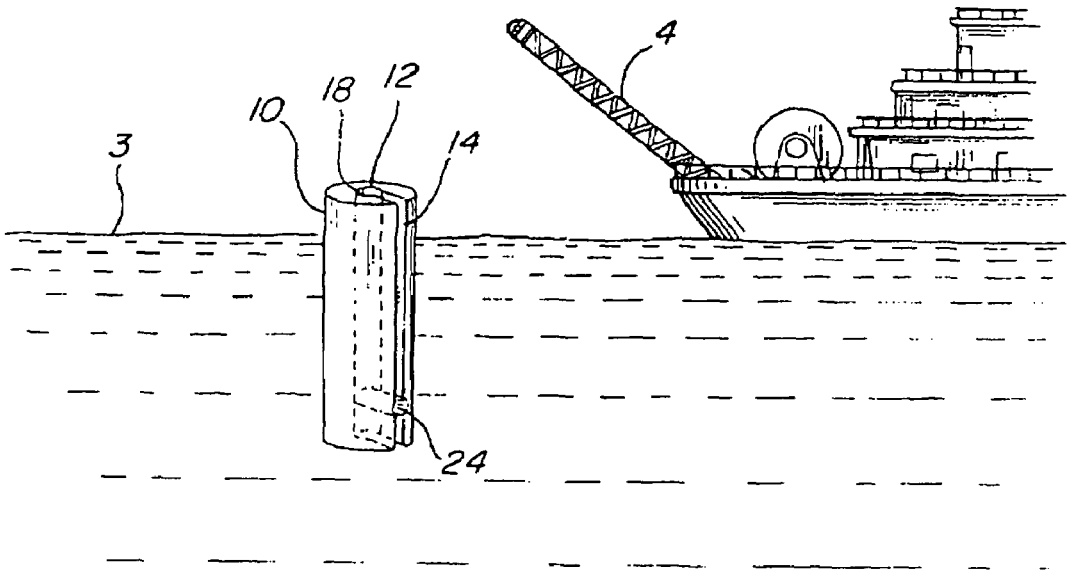
FIGS. 5A–5D are sequential perspective elevation views of a method of deploying a buoyancy can and associated riser in a body of water in accordance with the present invention.
Figure 5A:
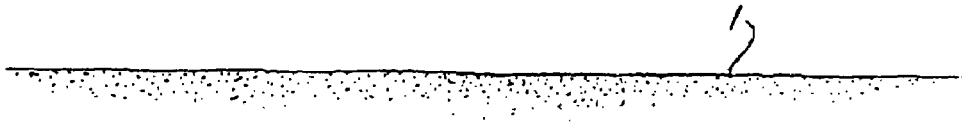
Figure 5B:
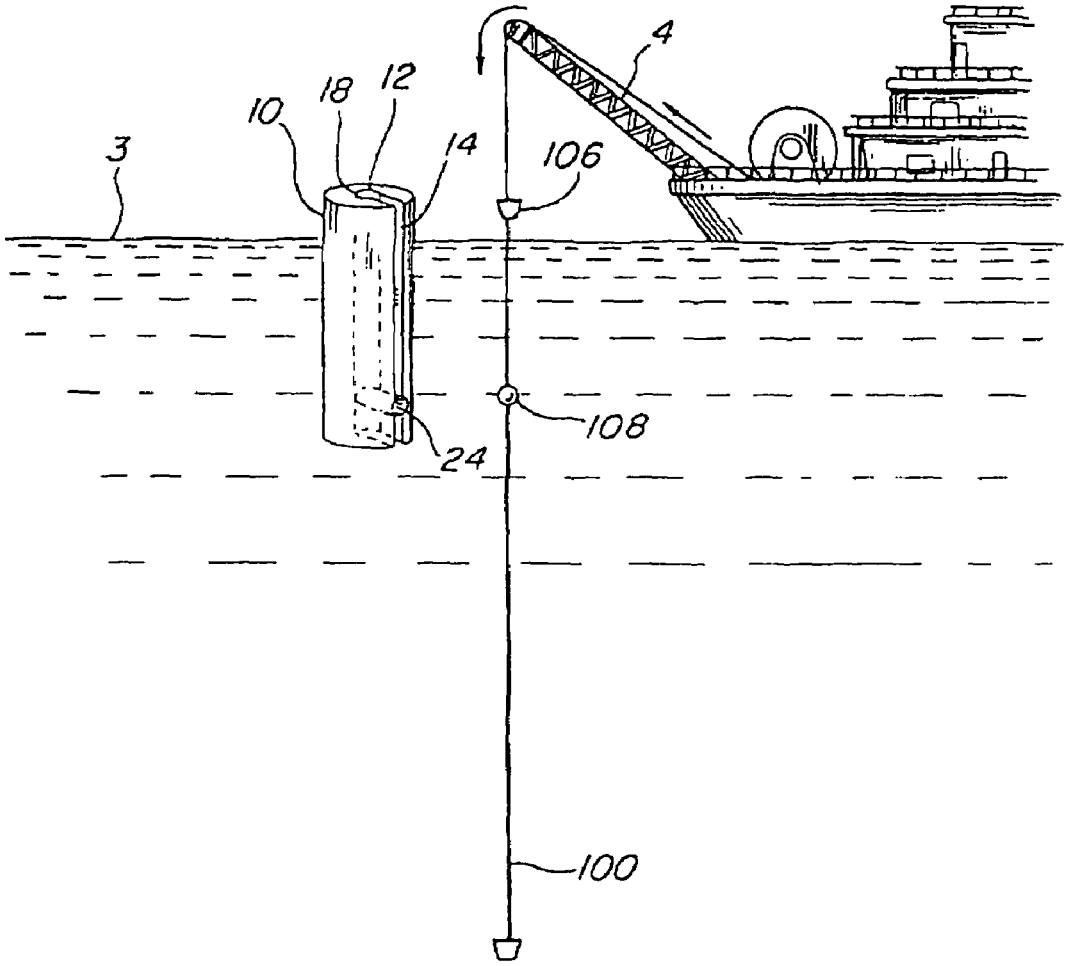
Figure 5B:
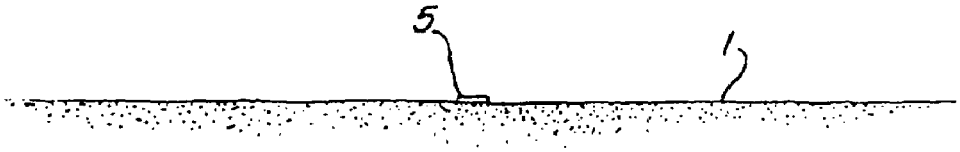
Figure 5C:
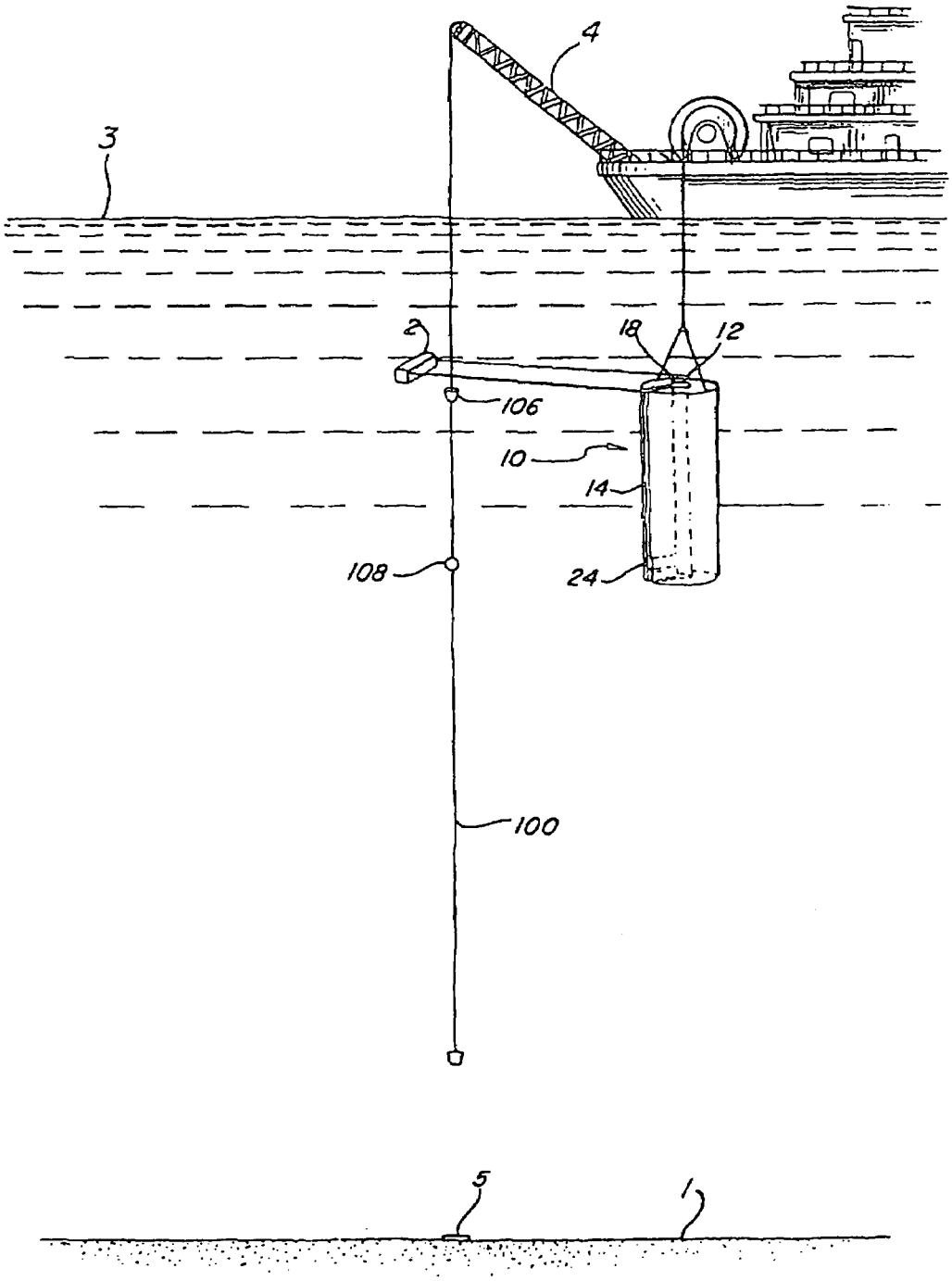

A buoyancy can 10 in accordance with the present invention is disposed in the water adjacent to the riser 100, either floating on the surface 3 of the water or submerged below it, and then manipulated, e.g., with an ROV 2 in a fully submerged deployment, such that the radio-axial slot 14 of the can faces toward and is aligned with the riser, as illustrated in FIGS. 5A, 5B. Additionally, the vertical position of at least one of the can and the riser is adjusted, e.g., by varying the buoyancy of the can, as above, or by raising or lowering the upper end of the riser with the crane 4, or both, until the first riser support feature 106 is positioned above the upper end 16 of the can, and the radial bore 24 of the can faces toward and is aligned with the second riser support feature 108, as illustrated in FIGS. 1 and 5C.

Figure 5D:
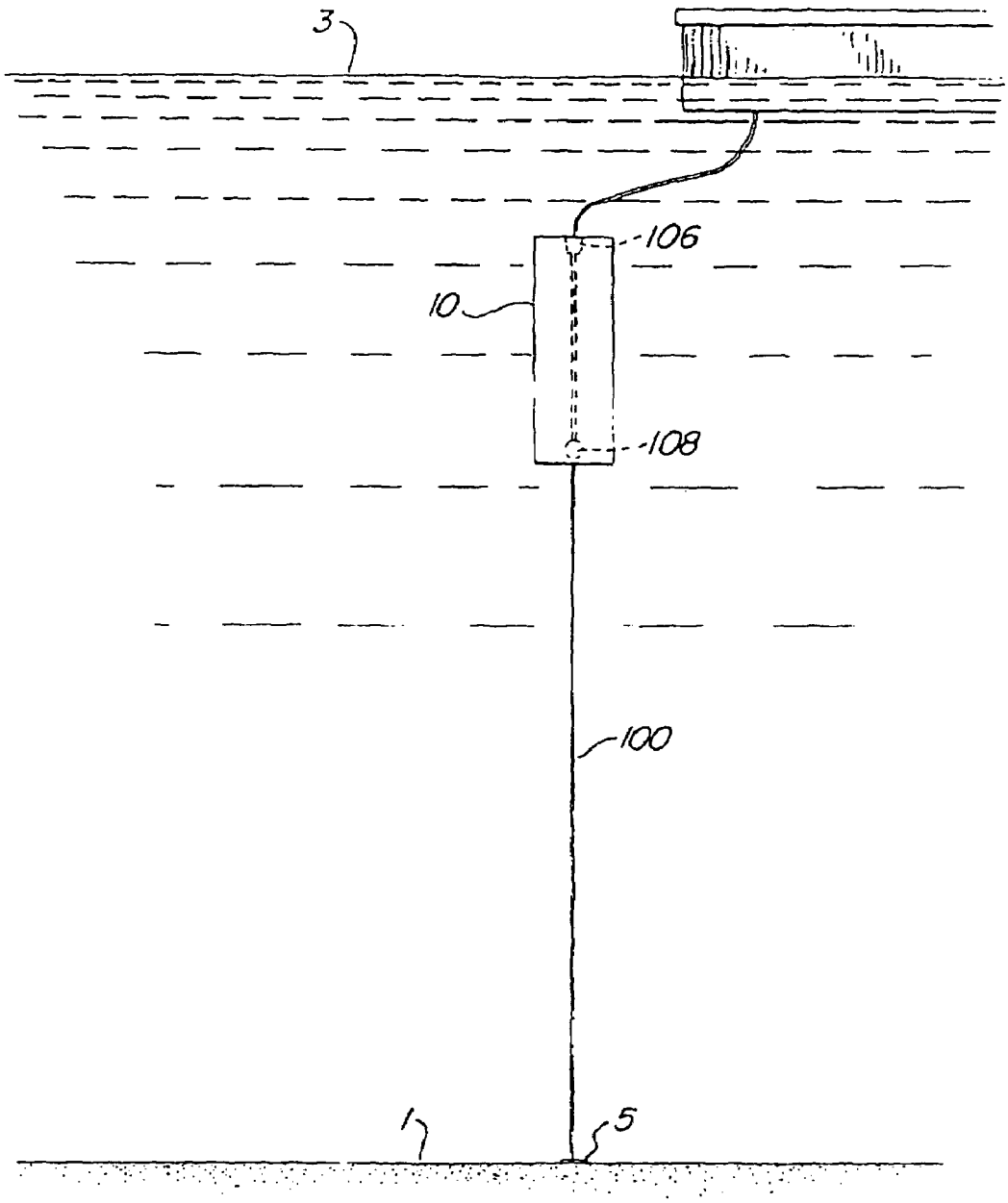

The can 10 and the riser 100 are then urged together laterally in the water, which again, in a fully submerged coupling, may be effected with the ROV 2, such that the riser and second riser support feature 108 respectively pass through the radio-axial slot 14 and the radial bore 24 of the can and are disposed coaxially in the axial bore 12 thereof. The vertical position of at least one of the can and the riser are then adjusted again, as above, i.e., by raising the can and/or lowering the riser, until the first and second riser support features 106 and 108 are axially seated in respective ones of their corresponding sockets 18 and 20 in the can, as illustrated in FIG. 5D.

The method whereby the buoyancy can 10 is decoupled from the riser 100 is generally the reverse of the foregoing procedure. Thus, it may be seen that the coupling and decoupling of the buoyancy can to and from the riser is easily effected without the need for removing the upper terminal portion of the riser or for divers in the water, whether the coupling or decoupling is effected on or below the surface 3 of the water.

Figure 10:
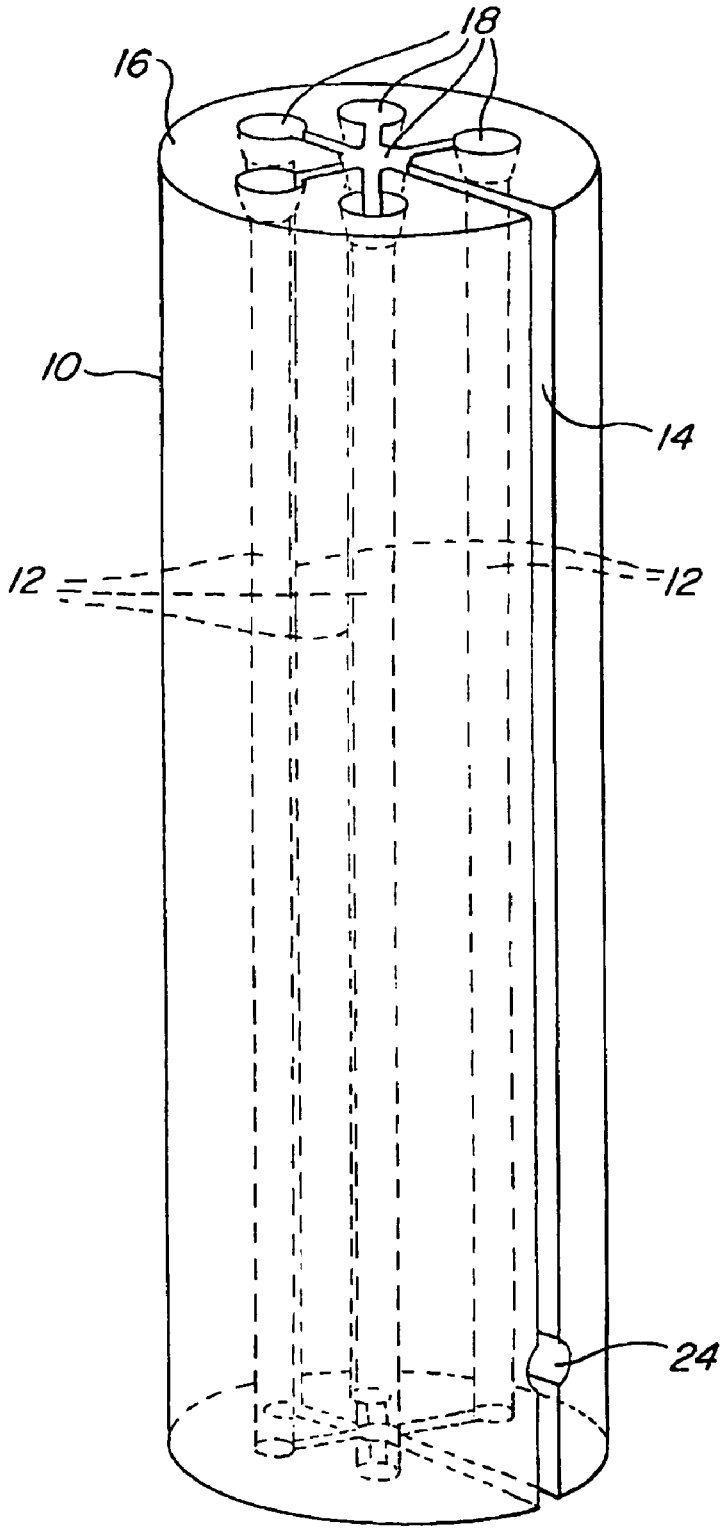

By now, those of skill in the art will appreciate that many modifications and substitutions can be made to the materials, methods and configurations of the present invention without departing from its scope. For example, as illustrated in FIG. 10, the buoyancy can 10 may include a plurality of axial bores 12, each capable of supporting a corresponding riser 100 coaxially therein, and in which each of the risers can be coupled to and decoupled from the can independently of the others without removing its respective upper terminal end portion.

Accordingly, the scope of the present invention should not be limited to the particular embodiments illustrated and described herein, as these are merely exemplary in nature. Rather, the scope of the present invention should be commensurate with that of the claims appended hereafter, and their functional equivalents.

What is claimed is:

1. Apparatus for supporting an upper end of an elongated vertical offshore oil and gas riser of a given diameter in a body of water, comprising:

a first support feature disposed on the riser adjacent an upper end thereof;

a buoyancy can including a vertical axial bore through which the riser extends coaxially;

a radio-axial slot extending through a side of the can and into the axial bore thereof, the slot having a width greater than the diameter of the riser; and a first socket disposed at an upper end of the axial bore and configured to receive the first support feature in a complementary, axial engagement, and to support the first support feature vertically.

2. The apparatus of claim 1, wherein the riser further includes a second support feature disposed coaxially thereon at a selected distance below the first support feature, and wherein the buoyancy can further comprises:

a second socket disposed in the axial bore thereof, the second socket being spaced below the first socket by the selected distance and adapted to receive the second support feature in a complementary, axial engagement, and to support the second support feature vertically.

3. The apparatus of claim 1, wherein the first support feature comprises a hang-off plug.

4. The apparatus of claim 2, wherein the second support feature comprises a riser ball having a given diameter, and wherein the radio-axial slot further comprises:

a radial bore extending through the side of the can and into the axial bore thereof, the radial bore having a diameter greater than the diameter of the riser ball.

5. The apparatus of claim 4, wherein the second support feature further comprises a pair of stress joints disposed back-to-back on the riser ball.

6. The apparatus of claim 2, wherein the second support feature comprises a stab-in connector having a cross-sectional profile, and wherein the radio-axial slot further comprises;

a radial bore extending through the side of the can and into the axial bore thereof, the radial bore having a cross-sectional profile larger than the cross-sectional profile of the stab-in connector.

7. The apparatus of claim 1, wherein the first support feature comprises a flex joint, and the first socket comprises a flex joint receptacle.

8. The apparatus of claim 4, wherein the second socket is disposed at a lower end of the buoyancy can and comprises a keel joint sleeve.

9. The apparatus of claim 6, wherein the second socket is disposed at a lower end of the buoyancy can and comprises a flex joint receptacle.

10. The apparatus of claim 1, wherein the can comprises at least one buoyant compartment, and wherein the buoyancy of the at least one compartment is adjustable.

11. The apparatus of claim 1, wherein the can further comprises a plurality of vertical axial bores, each capable of receiving and supporting a riser therein.

12. A method for supporting an upper end of an elongated vertical offshore oil and gas riser of a given diameter in a body of water, the method comprising:

suspending the upper end of the riser such that the lower end of the riser extends vertically below the surface of the water;

at least partially submerging a buoyancy can in the water adjacent to the riser, the can having a vertical axial bore and a radio-axial slot extending through a side of the can and into the axial bore, the slot having a width greater than the diameter of the riser; and urging the can laterally toward the riser such that the riser passes through the radio-axial slot in the can and is disposed coaxially in the axial bore thereof.

13. The method of claim 12, wherein to riser includes at least one support feature disposed coaxially thereon adjacent to the upper end thereof, and further comprising:

providing at least one socket in the axial bore of the buoyancy can, the at least one socket being adapted to receive the at least one support feature in a complementary, axial engagement, and to support the first support feature vertically; and, adjusting the vertical position of at least one of the riser and the buoyancy can such that the at least one support feature of the riser is axially seated in the at least one socket of the can.

* * * * *